United States Patent [19]

Stiasny

[11] 4,166,443

[45] Sep. 4, 1979

[54] JET PIPE BURNER

[75] Inventor: Carl-Heinz Stiasny, Bruneck, Italy

[73] Assignee: Birfield Trasmissioni S.p.A., Bruneck, Italy

[21] Appl. No.: 813,662

[22] Filed: Jul. 7, 1977

[30] Foreign Application Priority Data

Aug. 24, 1976 [IT] Italy ..... 26470 A/76

[51] Int. Cl.[2] ..... F24C 3/06

[52] U.S. Cl. ..... 126/91 A; 432/209

[58] Field of Search ..... 432/209; 126/91 R, 91 A

[56] References Cited

U.S. PATENT DOCUMENTS

| | | | |
|---|---|---|---|
| 3,285,240 | 11/1966 | Schmidt | 126/91 A |
| 3,361,185 | 1/1968 | Anderson et al. | 126/91 A |
| 4,062,343 | 12/1977 | Spielman | 126/91 A |

FOREIGN PATENT DOCUMENTS

| | | | |
|---|---|---|---|
| 2165172 | 7/1972 | Fed. Rep. of Germany | 126/91 A |

*Primary Examiner*—Carroll B. Dority, Jr.

*Attorney, Agent, or Firm*—Toren, McGeady and Stanger

[57] ABSTRACT

A jet pipe burner for heating the interior of an industrial furnace includes a jet pipe and a burner head positioned within the jet pipe. An air pipe and a gas pipe provide combustion air and fuel gas to the burner head. A gas-air mixer is connected to the air pipe and the gas pipe for mixing the combustion air and the fuel gas before they flow to the burner head. A valve, connected to the mixer, controls the supply of combustion air and fuel gas to the burner head. In one embodiment a ring-shaped air duct is arranged coaxially with and laterally enclosing the burner head for cooling the burner, the ring-shaped air duct has nozzles which open into the jet pipe. A conduit connected to the source of combustion air delivers cooling air into the ring-shaped air duct. In another embodiment radially projecting cooling plates formed of heat resistant material are angularly distributed about the circumference of the burner head.

2 Claims, 8 Drawing Figures

14
5
13
1
15
3
2
18
16
17
6
4
11
8
9
7
10
12

JET PIPE BURNER

BACKGROUND OF THE INVENTION

The present invention relates generally to an industrial furnace and, more particularly, to a jet pipe burner for heating the interior chamber of such a furnace. The jet pipe burner includes a burner head positioned within the jet pipe and receiving combustion air and fuel gas from a mixer over a control valve.

Jet pipe burners are generally known which include burner heads required to absorb large thermal stress. Adequate dissipation of the heat, however, is not provided in such jet pipe burners. Such a drawback leads to scaling within the ducts carrying the air-gas mixture to the burner and, as a result, the ducts quickly become clogged. Accordingly, readjustment or cleaning the burner is necessary. Additionally, under these conditions heating of the fuel gas involves the risk of coking and cracking and resultant inefficiency of the burner.

Therefore, one object of the present invention is to overcome the problem of scaling and harmful heating of the fuel gas within the burner, despite increased thermal stress, while maintaining a high operating efficiency of the burner.

Another object of the present invention is to provide means for dissipating the heat from the burner head within a jet pipe burner to prevent scaling within the ducts which supply an air-gas mixture to the burner, and for preventing dangerous heating of the fuel gas.

SUMMARY OF THE INVENTION

These objectives of the present invention are generally accomplished by providing a jet pipe burner for heating the interior of an industrial furnace, consisting of a jet pipe, a burner head arranged within the jet pipe, means for supplying combustion air and fuel gas to the burner head, a source of combustion air and a source of fuel gas connected to the supply means, a valve connected with the supply means for controlling the supply of combustion air and fuel gas to burner head, and means for dissipating the heat from the burner head. In one embodiment the heat dissipating means includes a ring-shaped air duct arranged coaxially with the burner head, the ring-shaped air duct has nozzles which open into the pipe, and a conduit is connected at one end to the source of combustion air and at its other end to the ring-shaped air duct for supplying cooling air to the duct.

An advantage of this arrangement is that the service life of the jet pipe burner is increased and the heating energy is more efficiently utilized. Further, maintenance costs are reduced as a result of the longer service life of the burner. A further advantage is that a part of the combustion air is mixed with the fuel gas before it reaches the burner head thus improving combustion. In addition, the shape and the length of the flame can be regulated.

As a further feature of the present invention, the conduit for supplying cooling air to the ring-shaped duct is connected to a supply pipe for combustion air at a point located upstream of the connection of the air pipe to a gas-air mixer. This feature provides the particular advantage that cooling of the burner head is effected only when the burner head is actually in operation.

In an alternate embodiment for dissipating heat from the burner head cooling plates made of a heat resistant material project radially outwardly from the circumference of the burner head and extend over its entire length.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE INVENTION

Figure 1:
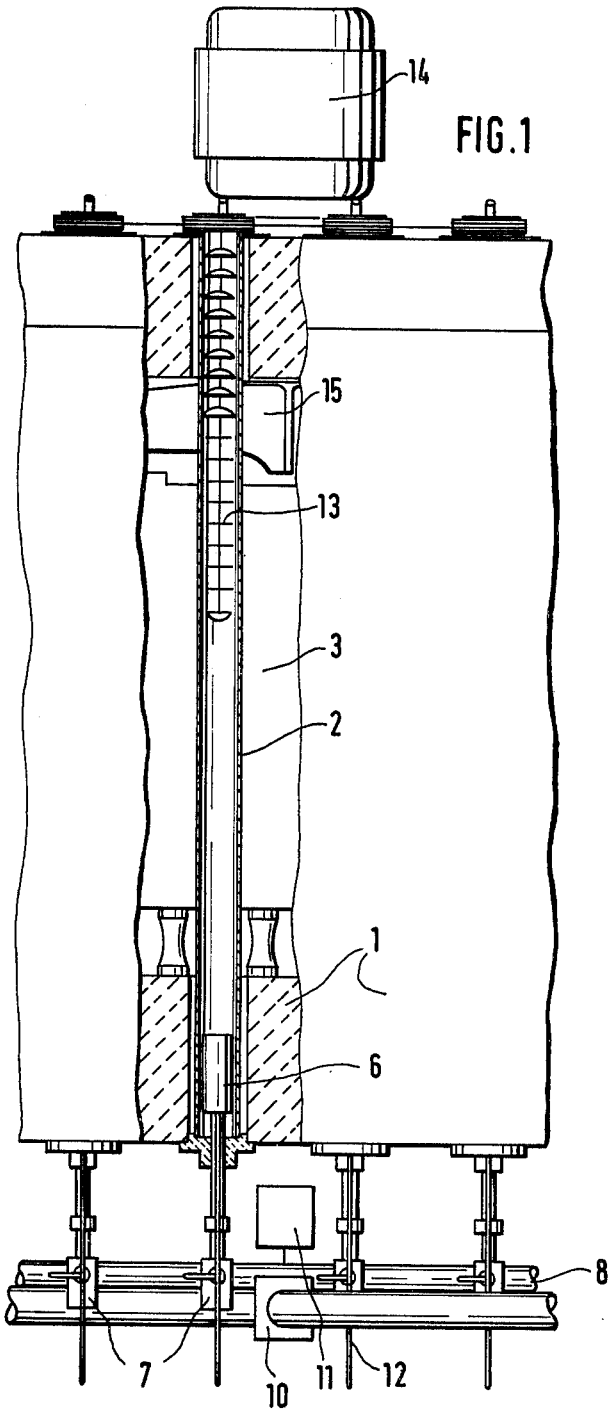
FIG. 1 is a side elevational view illustrating a portion of an industrial furnace with a jet pipe shown in section.
Figure 2:
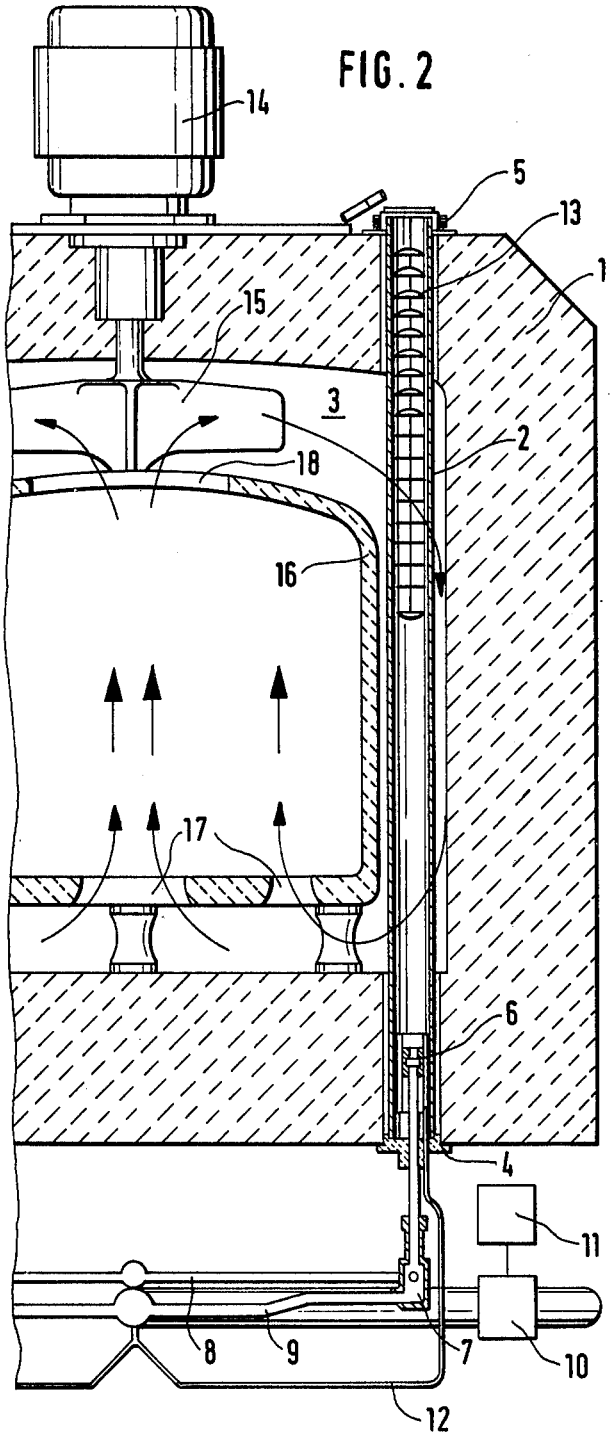
FIG. 2 is a sectional view taken through the furnace shown in FIG. 1.

In FIGS. 1 and 2 a portion of an industrial furnace is illustrated consisting substantially of refractory brick work 1 forming the outer furnace casing. Within the furnace interior 3 a number of jet pipes 2 extend in side-by-side relation. The jet pipes 2 supply heat to the interior 3 of the furnace. Jet pipes extend through the brick work 1 and are sealed off from it by seals 4 and 5 at the inlet and the outlet openings, respectively.

A burner 6 is located in the lower part of each jet pipe 2. Fuel gas is supplied to the burner 6 from a gas-air mixer 7. A fuel gas pipe 8 and an air pipe 9 are connected to the gas-air mixer 7 to provide a source of supply of fuel gas and combustion air. The supply of gas and air is controlled by a valve 10 by means of a servo motor 11. The number of jet pipes provided depends upon the size of the furnace and the heat required for the working temperature range. Each jet pipe 2 contains a burner 6 which is supplied via a gas-air mixer 7. All gas-air mixers 7 are connected to the common gas-air pipes 8 and 9 controlled by valve 10. In the operation of the device, the control valve 10 directly controls the amount of air to be supplied to the gas-air mixer 7 and this has the effect of also controlling the amount of fuel gas supplied. The equipment operates to directly control the amount of air supply and this has the effect of indirectly operating to provide a corresponding amount of gas with both being supplied to the burner 6.

In the embodiment shown in FIGS. 1 and 2, cooling air is supplied to the burner 6 by an additional air pipe 12 which receives the air from the supply air pipe 9.

A flame breaker 13 is located in the upper part of each jet pipe 2 for better utilization of the heat generated within the jet pipe. The flame breaker 13 prevents the heating gas from issuing too rapidly from the jet pipe, increasing the effective time for heat transfer.

A blower 15 is supported in the interior 3 of the furnace from the brick work 1 in the roof and it is driven by a motor 14. Blower 15 insures proper gas circulation, note the gas flow path shown by the arrows in FIG. 2. The gas is drawn upwardly from the chamber 16 within the furnace and blown downwardly flowing over the jet pipes. Furnace chamber 16 holds the work pieces, not shown, which are heat treated within the furnace. A protective gas is circulated by the blower over the jet pipes 2 and through the chamber 16 for contact with the work pieces. Protective gas flow enters the chamber 16 via the inlet openings 17 at the bottom and exits through outlet openings 18 at the top.

Figure 3:
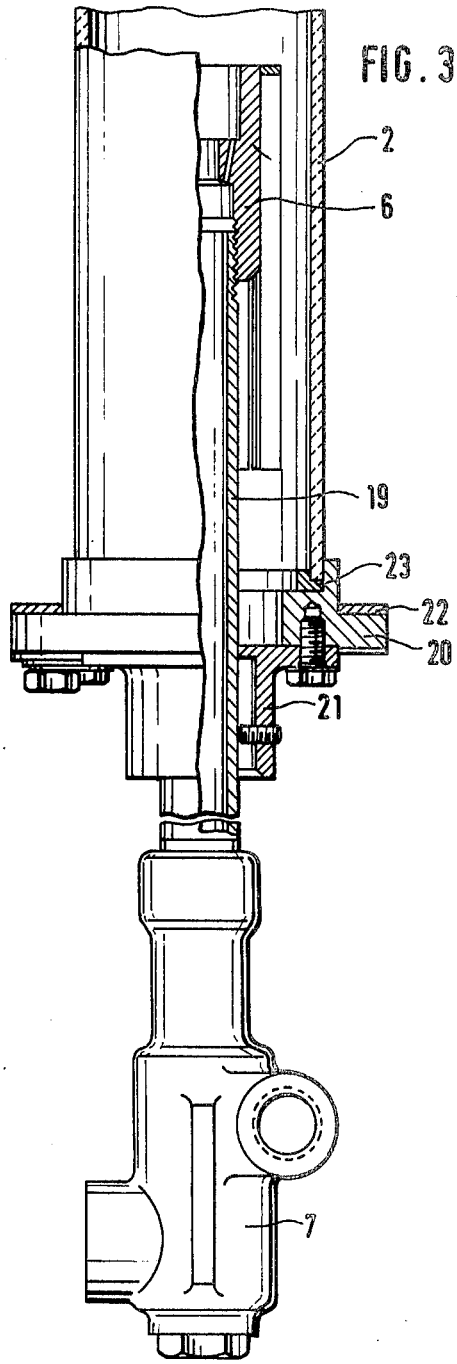
FIG. 3 is an enlarged view partly in elevation and partly in section showing the jet pipe of FIG. 1 and the details of the burner.

FIG. 3 provides a detailed showing of jet pipe 2 containing the burner 6. The burner is supplied with fuel gas from the gas-air mixer 7 through a burner pipe 19. Burner pipe 19 is surrounded by a burner coupling 21 carrying a flange 20. Flange 20 is sealed from brick work 1 by seal 22 and another seal 23 is positioned between the flange and the jet pipe 2. Burner 6 is rigidly connected to the burner pipe 19 and can be arranged in different forms by welding construction, such as shown in FIGS. 4 through 8.

Figure 5:
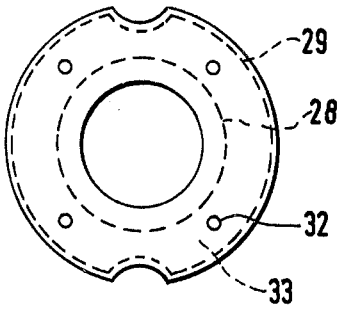
FIG. 5 is a plan view of the burner shown in FIG. 4.
Figure 4:
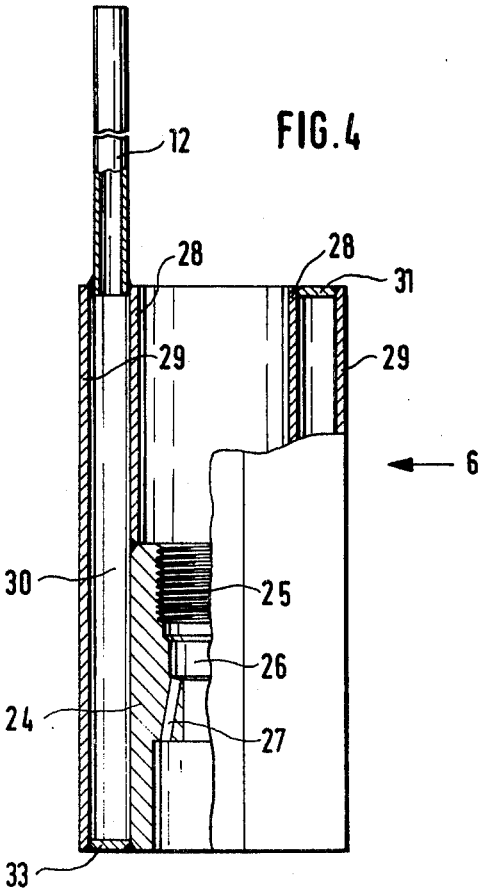
FIG. 4 is an elevational view, partly in section, showing a burner head with a ring-shaped cooling duct and a connecting pipe.

FIGS. 4 and 5 show one embodiment of the present invention in which the burner 6 consists substantially of a burner head 24, a cylindrical bore 25 for receiving burner pipe 19, and a gas-air mixing nozzle 26. Additional gas-air ducts 27 are provided to improve flame formation.

In this embodiment, burner head 24 is surrounded by a ring-shaped cooling duct 30 for dissipating the heat. The ring-shaped cooling duct 30 is formed by an inner pipe 28 laterally enclosed by an outer pipe 29. The ring-shaped cooling duct 30 is closed by a ring cover 31 located on the side of the duct facing in the direction of the lower end of the jet pipe 2. A single bore is provided through the ring 31, and air pipe 12 is connected to the cooling duct 30 through the single bore in the ring. At its opposite end, the air pipe 12 is connected with the air supply pipe 9 (see FIG. 2), which leads to the gas-air mixer 7. A ring 33 containing several bores 32 (note FIG. 5) closes the opposite side of the cooling duct 30 from the ring cover 31. This arrangement provides cooling of the burner only during actual operation of the burner, since cooling air will be shunted into the air pipe 12 to cool the burner head 24 only when valve 10 is open to supply combustion air and fuel gas to the burner. The air provided through pipe 12, for cooling the burner head 24, is subsequently fed through the bores 32 in the ring 33 for augmenting combustion within the jet pipes.

Figure 7:
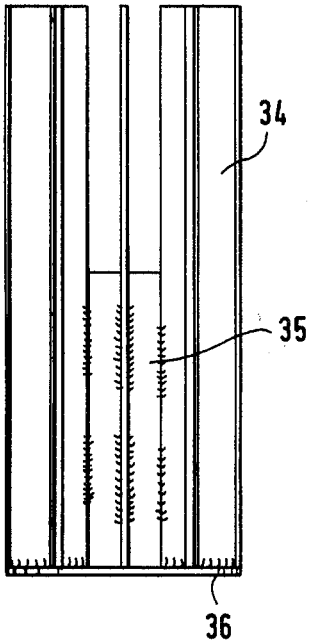
FIG. 7 is a side elevational view of the burner head shown in FIG. 6.
Figure 6:
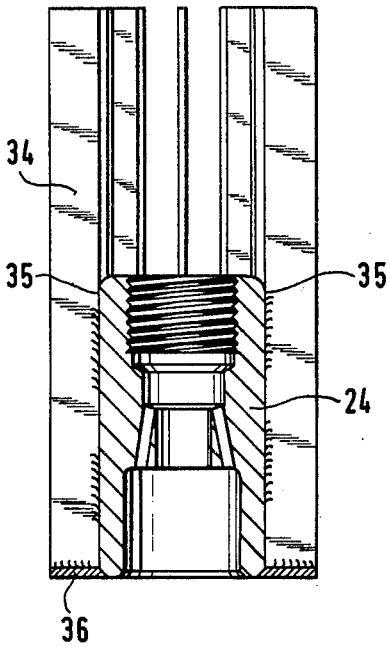
FIG. 6 is an elevational view partly in section, displaying a burner head having radially projecting cooling plates.
Figure 8:
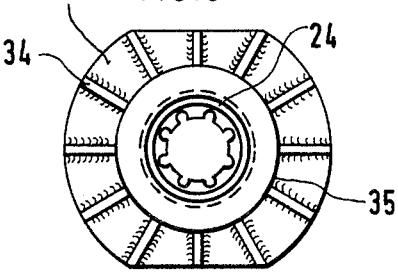
FIG. 8 is a plan view of the burner head shown in FIG. 6.

A further embodiment of the present invention for cooling the burner head is shown in FIGS. 6 through 8. The burner head 24 is the same as shown in FIG. 4 and is provided with cooling plates 34 arranged in a general star formation and projecting outwardly from the burner for dissipating the heat. Each of the cooling plates 34 are made of a heat resistant material and are welded along one edge to the outer jacket 35 of the burner head. The plates 34 are spaced angularly apart arranged about the circumference of the jacket 35 forming the star-shaped configuration. At the end of the burner the plates are also welded to a ring 36 and they extend in the axial direction of the jet pipes for the entire length of the burner head.

While specific embodiments of the invention have been shown and described in detail to illustrate the application of the inventive principles, it will be understood that the invention may be embodied otherwise without departing from such principles.

What is claimed is:

1. In a jet pipe burner assembly for heating the interior of an industrial furnace including a jet pipe, a burner head having a front face with orifice means formed in said front face and arranged within said jet pipe, means for supplying combustion air and fuel gas to said burner head, means for connecting a source of combustion air and a source of fuel gas to said supply means, and means connected with said supply means for controlling said supply of combustion air and fuel gas to said burner head, wherein the improvement comprises heat dissipating means constructed in a configuration laterally enclosing said burner head within said jet pipe for dissipating heat from said burner head, said heat dissipating means comprising annular wall means arranged concentrically with said burner head, said annular wall means defining together with the outer surface of said burner head an annular air duct extending laterally around and forward of the front face of said burner head in concentric relationship therewith, a conduit connected between one end of said annular air duct and said source of combustion air for supplying as cooling air to said air duct air from said source of combustion air, and means defining at an end of said air duct opposite said one end openings for passing said cooling air from within said air duct to said jet pipe.

2. A jet pipe burner, as set forth in claim 1, wherein said supply means comprises a gas-air mixer, said connecting means comprises a combustion air pipe and a fuel gas pipe for supplying combustion air and fuel gas respectively to said gas-air mixer, said valve being connected to said combustion air pipe upstream from the connections thereof to said gas-air mixer, and said conduit for supplying cooling air to said ring-shaped duct comprising an air pipe connected to said combustion air pipe at a point spaced upstream from said gas air mixer.

* * * * *